United States Patent [19]

Brüning et al.

[11] 4,327,057

[45] Apr. 27, 1982

[54] APPARATUS FOR THE COMBUSTION OF HARMFUL GASES

[75] Inventors: Rolf Brüning, Bruchköbel; Jürgen Roth, Maintal, both of Fed. Rep. of Germany

[73] Assignee: Heraeus Quarzschmelze GmbH, Hanau, Fed. Rep. of Germany

[21] Appl. No.: 195,162

[22] Filed: Oct. 8, 1980

[30] Foreign Application Priority Data

Oct. 20, 1979 [DE] Fed. Rep. of Germany ... 7929723[U]

[51] Int. Cl.[3] ..... F01N 3/04; F01N 3/26; F01N 3/34; F01N 3/38

[52] U.S. Cl. ..... 422/173; 422/182

[58] Field of Search ..... 422/99, 101, 173, 182, 422/183, 194, 201, 202

[56] References Cited

U.S. PATENT DOCUMENTS

| | | | |
|---|---|---|---|
| 3,073,684 | 1/1963 | Williams, Sr. | 422/182 X |
| 3,297,411 | 1/1967 | Dear | 422/202 X |
| 3,403,001 | 9/1968 | Mas et al. | 422/202 X |
| 3,959,307 | 5/1976 | Wittmann et al. | 422/202 X |
| 4,238,451 | 12/1980 | Ciais et al. | 422/101 |
| 4,248,806 | 2/1981 | Graat et al. | 422/194 X |

*Primary Examiner*—Bradley Garris

*Attorney, Agent, or Firm*—Sprung, Felfe, Horn, Lynch & Kramer

[57] ABSTRACT

An apparatus for the oxidative combustion of harmful gases by means of a burner is disclosed. The apparatus comprises a vertically disposed cooling jacket provided with a coolant inlet and coolant outlet which surrounds a combustion chamber. The combustion chamber is connected to and in gaseous communication with a condenser disposed therebeneath. A flushing device is provided in fluid communication with these components, the same being disposed above the combustion chamber and in gaseous communication therewith. A burner is disposed above the flushing device. An electrical igniter is disposed between the flushing device and the burner.

6 Claims, 1 Drawing Figure

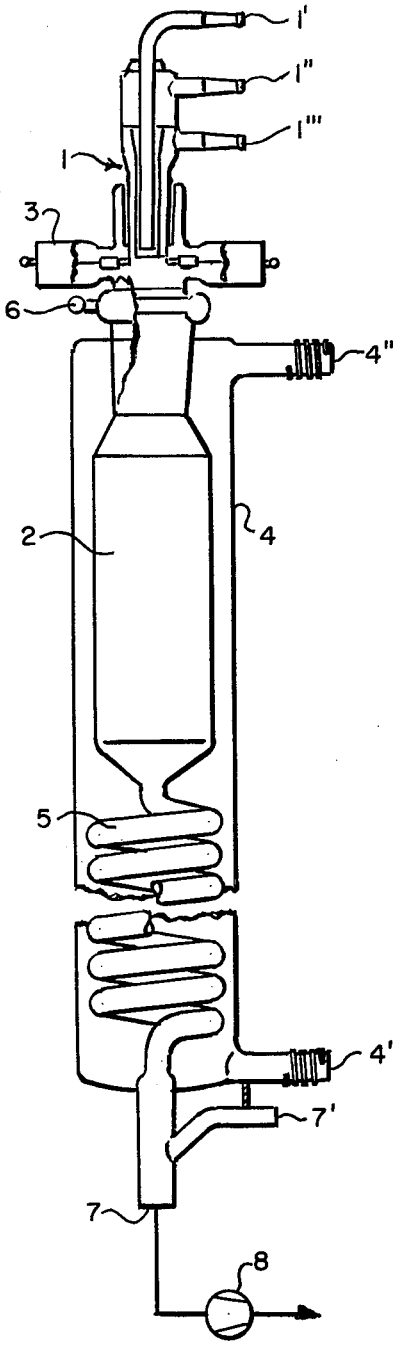
1'
1"
1'''
1
3
6
4"
2
4
5
4'
7'
7
8

APPARATUS FOR THE COMBUSTION OF HARMFUL GASES

BACKGROUND OF THE INVENTION

1. Field of the Invention

The present invention relates to an apparatus for the oxidative combustion of harmful gases by means of a burner.

2. Discussion of the Prior Art

The oxidative combustion of harmful gases is advantageous in all cases in which the combustion results in compounds which can be harmlessly disposed of or pose no threat to the environment. Many substances used in technology are highly toxic and in certain reactions they have to be used in an excess. Only in a few cases is it possible to conduct the reaction in a closed circuit. In all other cases it is necessary to dispose of harmful gases. The release of such gases to the atmosphere is restricted by increasingly stringent laws.

SUMMARY OF THE INVENTION

It is the object of the present invention to provide an apparatus for the harmless elimination of toxic gases.

This object and others are accomplished by an apparatus for the oxidative combustion of harmful gas by means of a burner, the apparatus being characterized by the fact that, above a vertically disposed cooling jacket provided with coolant inlet and outlet and surrounding a combustion chamber and a condenser connected to the latter and disposed beneath it, a flushing device is disposed, the burner is disposed above the flushing device, and an electrical igniter is disposed between the flushing device and the burner. Additional advantageous features of the invention will appear in the ensuing description of an apparatus pursuant to the invention.

BRIEF DESCRIPTION OF DRAWING

An embodiment of the apparatus of the invention is illustrated diagrammatically in the drawing.

DESCRIPTION OF SPECIFIC EMBODIMENT

The harmful gas that is to be burned is fed through the burner 1 and totally burned in the water-cooled combustion chamber 2. The combustion takes place at a pressure of about 500 mbar and is aided by a secondary flame. A hydrogen-oxygen diffusion flame has proven to be an effective secondary flame. The burner 1 has three concentric nozzles, the harmful gas being introduced through the feed line 1' into the innermost nozzle. Hydrogen is fed to through line 1'' to the middle nozzle surrounding the innermost nozzle. Oxygen is fed into the outer nozzle through line 1'''. Oxygen must always be supplied in an excess during combustion so as to assure quatitative oxidation of the harmful gas.

Beneath the burner mouth is situated the igniter 3. Typically an electric igniter connected to a source of electricity (not shown) is employed. Also therebeneath and beneath the igniter is a flushing means 6 which communicates with the combustion chamber 2. The flushing means is connected to a source of flushing liquid (not shown). In the flushing means, a film of liquid is produced which uniformly wets the entire inside surface of the combustion chamber.

In the device of the invention the burner and feed lines can consist of vitreous fused silica. Additionally, the ignitor means, flushing means, cooling jacket, combustion chamber and condenser can consist of vitreous fused silica or glass. The device of the invention can be one in which the burner, igniter with flushing means, cooling jacket with cooling chamber and condenser form, in each case one unit, each being joined to the other by a ground glass joint.

An air supply connection 7', serving for the precise regulation of the working pressure of the apparatus, is connected to the suction connection 7 to which a water ring pump 8 is connected. Water is circulated as coolant through the inlet 4' and outlet 4'' for the cooling of the combustion chamber 2 and of the condenser 5. The flushing means is connected to a source of flushing liquid (not shown). The flushing liquid and the combustion products enter together into the condenser 5 and are aspirated through the connection 7. The combustion products condense in the condenser 5 and are there absorbed by the flushing liquid.

The apparatus of the invention has proven itself in practice. For example, it is capable of the virtually complete burning, i.e., annihilation, of phosphine and diborane. Other gases which can be oxidatably combusted by the apparatus of the invention include:

$H_2S$; HCN, $(CN)_2$, $SiH_4$, $SiR_4$ with $R=CH_3$ or $C_2H_5$

What is claimed is:

1. An apparatus for the oxidative combustion of harmful gases comprising a vertically disposed cooling jacket provided with a coolant inlet and a coolant outlet, a combustion chamber surrounded by said cooling jacket and a condenser connected to said combustion chamber and disposed therebeneath, a flushing device disposed above said combustion chamber and in gaseous communication therewith, said flushing device being arranged and constructed to wet the inside surface of said combustion chamber with a film of liquid, a burner disposed above said flushing device and in gaseous communication with said flushing device and an electrical igniter disposed between said flushing device and said burner.

2. An apparatus according to claim 1, wherein said burner comprises three concentric nozzles of which the innermost nozzle is connected to a source of harmful gas, via a harmful gas feedline, the middle nozzle is connected to a source of hydrogen via a hydrogen feed line and the outer nozzle is connected to a source of oxygen via an oxygen feed line.

3. An apparatus according to claim 2, wherein said burner and said feed lines consist of vitreous fused silica.

4. An apparatus according to claim 1, wherein said igniter, said flushing means, said cooling jacket, said combustion chamber and said condenser consist of vitreous fused silica or glass.

5. An apparatus according to claim 1, wherein said burner, said igniter with said flushing means, said cooling jacket with said combustion chamber and said condenser form, in each case, one unit, each being joined to the other by a ground glass joint.

6. An apparatus according to claim 1, wherein an air feed connection opens into a suction connection of said condenser.

* * * * *